US008997373B1

(12) United States Patent
Lawson

(10) Patent No.: US 8,997,373 B1
(45) Date of Patent: Apr. 7, 2015

(54) SKATE BLADE DRYER

(76) Inventor: Raymond J. Lawson, Goderich (CA)

( * ) Notice: Subject to any disclaimer, the term of this patent is extended or adjusted under 35 U.S.C. 154(b) by 1113 days.

(21) Appl. No.: 13/011,065

(22) Filed: Jan. 21, 2011

(51) Int. Cl.

| | |
|---|---|
| ***F26B 19/00*** | (2006.01) |
| ***F26B 3/04*** | (2006.01) |
| ***F26B 9/00*** | (2006.01) |
| ***F26B 3/02*** | (2006.01) |

(52) U.S. Cl.
CPC . *F26B 3/04* (2013.01); *F26B 9/003* (2013.01); *F26B 3/02* (2013.01)

(58) Field of Classification Search
CPC ..... F26B 9/003; F26B 3/02; F26B 3/04
USPC ..... 34/202, 215
See application file for complete search history.

(56) References Cited

U.S. PATENT DOCUMENTS

| | | | | | |
|---|---|---|---|---|---|
| 3,358,386 | A | * | 12/1967 | Perry, Jr. | 34/208 |
| 4,236,063 | A | * | 11/1980 | Glucksman | 219/400 |
| 4,812,621 | A | | 3/1989 | Brotherton et al. | |
| 4,993,172 | A | | 2/1991 | Allen | |
| 5,361,749 | A | * | 11/1994 | Smith et al. | 126/21 A |
| 5,775,518 | A | * | 7/1998 | Connor | 211/70.7 |
| D420,764 | S | | 2/2000 | Conway et al. | |
| 6,038,786 | A | | 3/2000 | Aisenberg et al. | |
| 6,079,108 | A | * | 6/2000 | Lin | 30/298.4 |
| 2008/0168677 | A1 | * | 7/2008 | Miller | 34/202 |
| 2008/0282576 | A1 | | 11/2008 | Ueda et al. | |
| 2009/0175988 | A1 | * | 7/2009 | Khanania | 426/236 |
| 2010/0012150 | A1 | | 1/2010 | Mixdorf | |

* cited by examiner

*Primary Examiner* — Kenneth Rinehart
*Assistant Examiner* — Gajanan M Prabhu

(57) ABSTRACT

A skate blade dryer is provided for removing moisture from a skate blade after use to prevent rust, discoloration, pitting, and premature dulling of the skate blade. The dryer includes a housing having an interior, a top, and a front face. A blower is positioned in the interior of the housing. A conduit extends from the housing. The conduit includes a slot configured for receiving a skate blade coupled to a skate boot. The blower has an output port in fluid communication with the conduit for directing air flow through the conduit.

18 Claims, 4 Drawing Sheets

SKATE BLADE DRYER

BACKGROUND OF THE DISCLOSURE

Field of the Disclosure

The disclosure relates to drying devices and more particularly pertains to a new drying device for removing moisture from a skate blade after use to prevent rust, discoloration, pitting, and premature dulling of the skate blade.

SUMMARY OF THE DISCLOSURE

An embodiment of the disclosure meets the needs presented above by generally comprising a housing having an interior, a top, and a front face. A blower is positioned in the interior of the housing. A conduit extends from the housing. The conduit includes a slot configured for receiving a skate blade coupled to a skate boot. The blower has an output port in fluid communication with the conduit for directing air flow through the conduit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
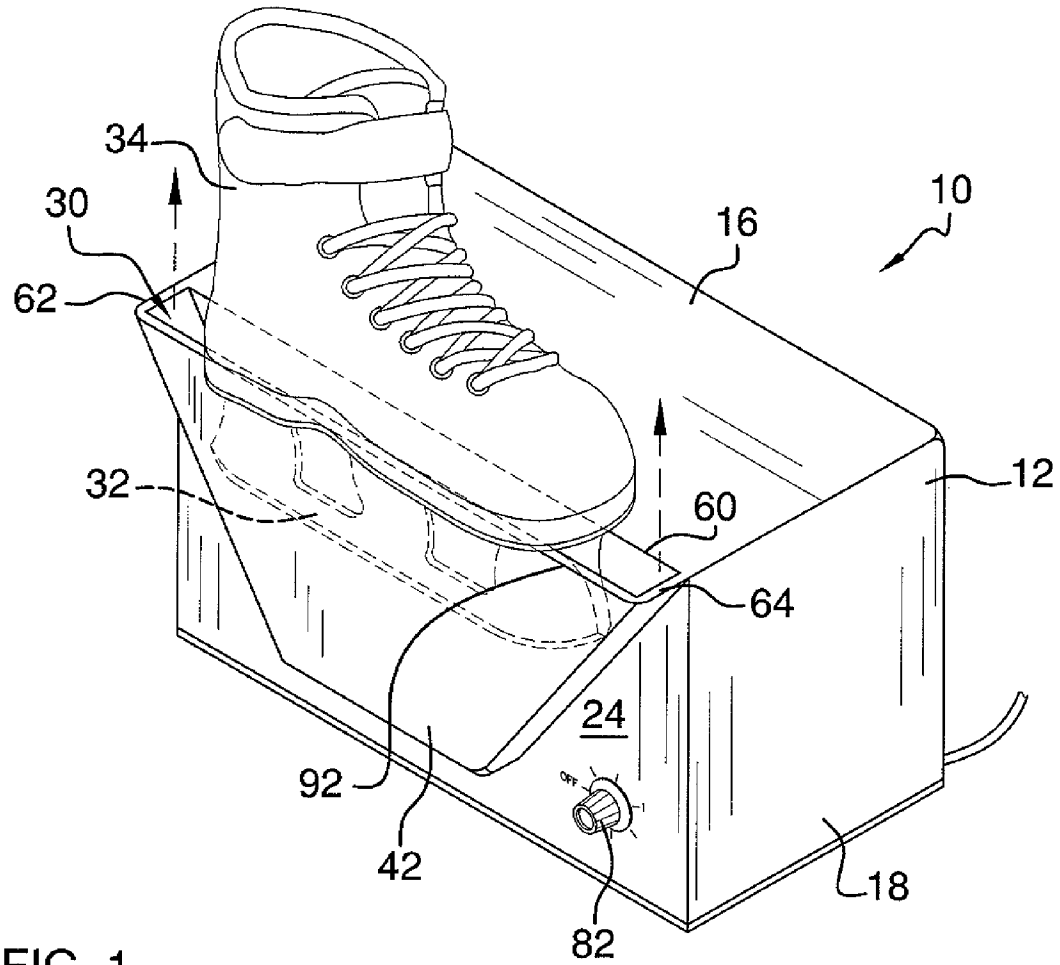
FIG. 1 is a top front side perspective view of a skate blade dryer according to an embodiment of the disclosure.
Figure 2:
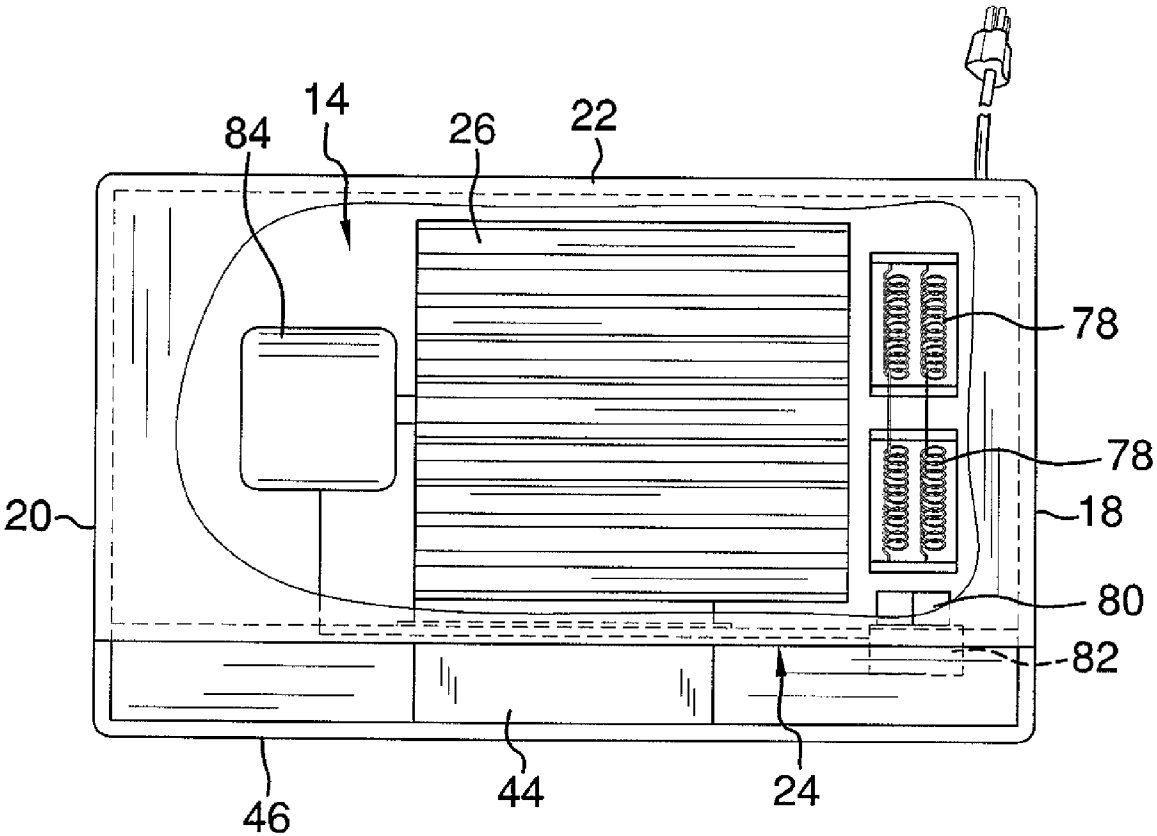
FIG. 2 is a partial cut-away top view of an embodiment of the disclosure.
Figure 3:
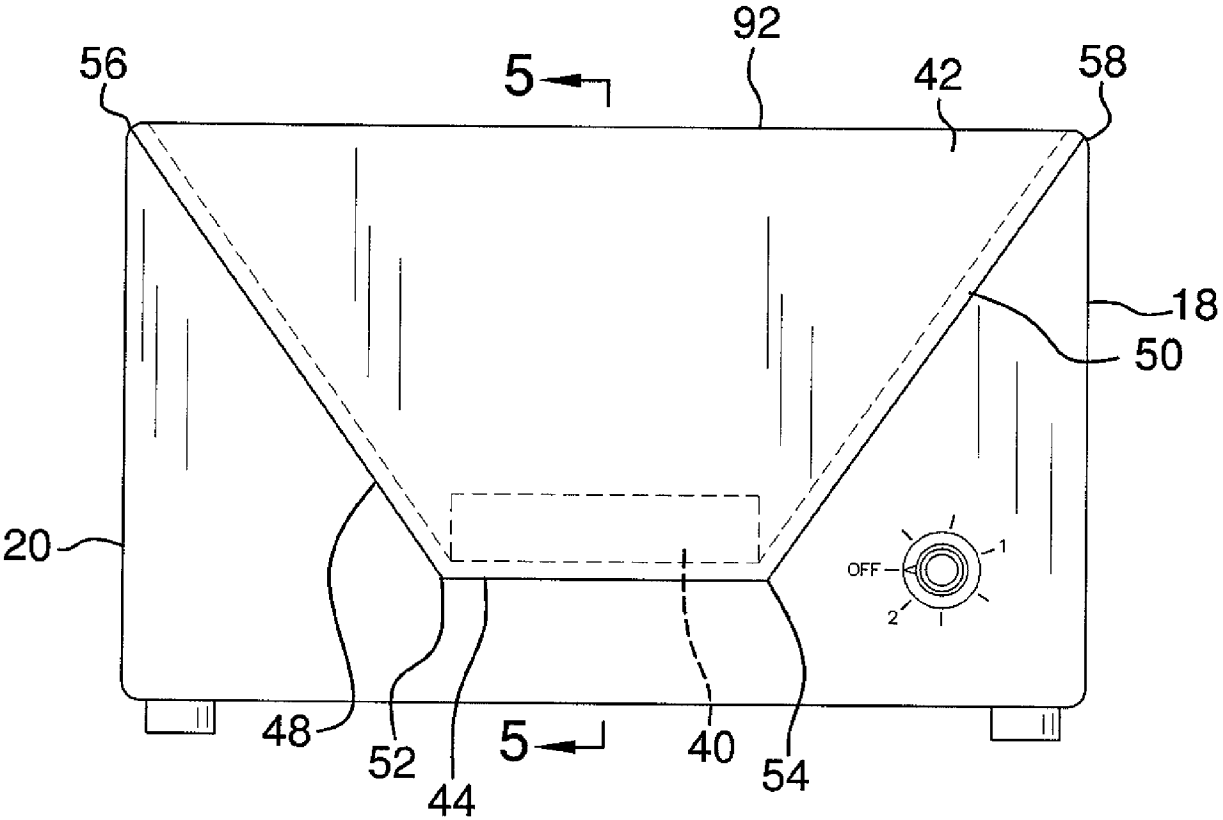
FIG. 3 is a front view of an embodiment of the disclosure.
Figure 5:
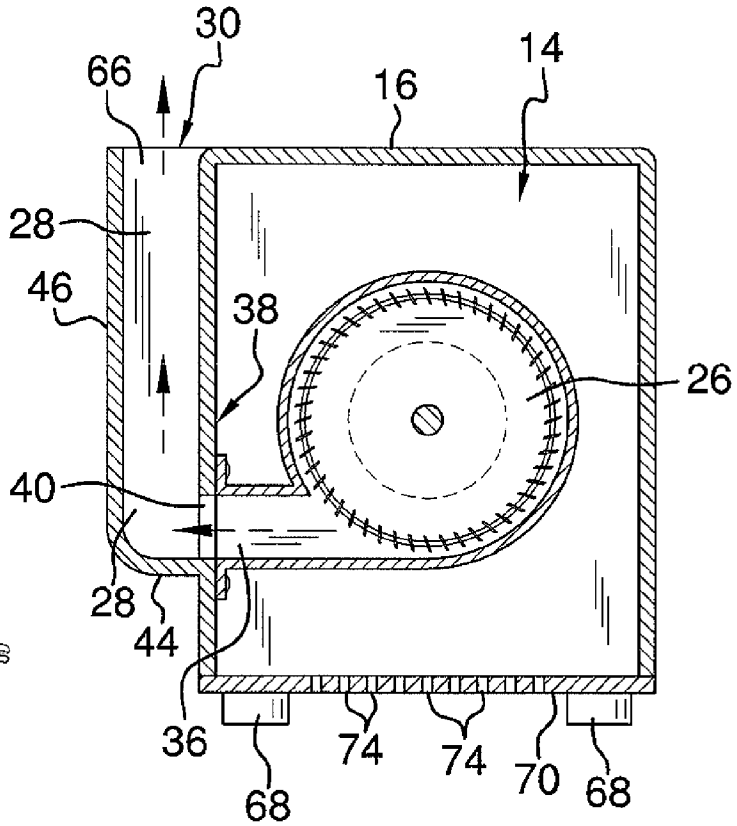
FIG. 5 is a cross-sectional view of an embodiment of the disclosure taken along line 5-5 of FIG. 3.
Figure 4:
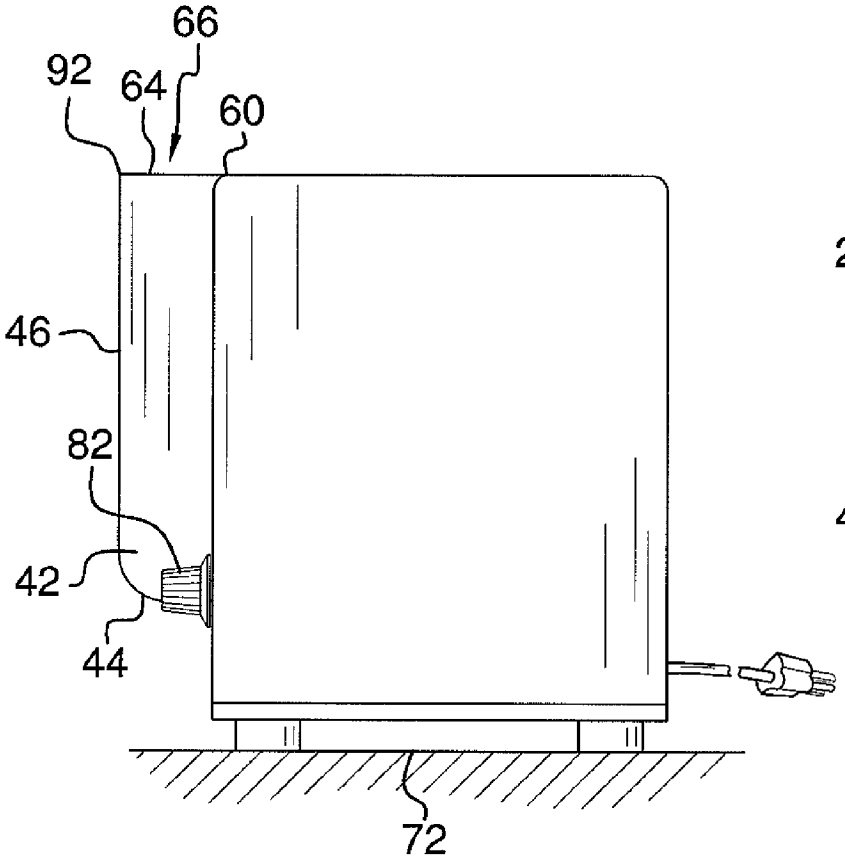
FIG. 4 is a side view of an embodiment of the disclosure.

With reference now to the drawings, and in particular to FIGS. 1 through 5 thereof, a new drying device embodying the principles and concepts of an embodiment of the disclosure and generally designated by the reference numeral 10 will be described.

As best illustrated in FIGS. 1 through 5, the skate blade dryer 10 generally comprises a housing 12 having an interior 14, a top 16, a pair of sides 18,20, a back 22, and a front face 24. A blower 26 is positioned in the interior 14 of the housing 12. A conduit 28 extends from the housing 12. The conduit 28 has a slot 30 configured for receiving a skate blade 32 coupled to a skate boot 34. The blower 26 has an output port 36 coupled to an interior surface 38 of the housing around an opening 40 through the front face 24 of the housing. The conduit 28 extends from the opening 40. Thus, the output port 36 is in fluid communication with the conduit 28 for directing air flow through the conduit 28 and onto the skate blade 32 to promote and enhance drying of the skate blade 32. The conduit 28 is formed by a shroud 42 coupled to the front face 24 of the housing 12. The shroud 42 includes a bottom 44, a front wall 46 extending upwardly from the bottom 44, and a pair of end walls 48,50 extending from ends 52,54 of the bottom 44 of the shroud 42. The end walls 48,50 also extend between the front face 24 of the housing 12 and side edges 56,58 of the front wall 46 of the shroud 42. The slot 30 is formed by an upper edge 60 of the front face 24 of the housing 12, upper edges 62,64 of the end walls 48,50 of the shroud 42, and the front wall 46 of the shroud 42. The upper edge 60 of the front face 24 of the housing 12, the upper edges 62,64 of the end walls 48,50 of the shroud 42, and the upper edge 92 of the front wall 46 of the shroud 42 are all coplanar. The end walls 48,50 extend upwardly and outwardly from the bottom 44 of the shroud 42. Thus, a top 66 of the conduit 28 is wider than the bottom 44 of the shroud 42.

A plurality of feet 68 is coupled to a bottom 70 of the housing 12. The feet 68 are configured for supporting the bottom 70 of the housing 12 in spaced relationship to a support surface 72. A plurality of vents 74 is also positioned in the bottom 70 of the housing 12. The vents 74 are configured for permitting fluid communication and air flow between the interior 14 of the housing 12 and a surrounding area 76 around the housing 12.

At least one heating element 78, or multiple heating elements 78, are positioned in the interior 14 of the housing 12. The heating elements 78 are positioned proximate the blower 26 for heating air directed through the conduit 28 by the blower 26. The heated air enhances the drying effect on the skate blades 32.

A timer 80 is operationally coupled to the blower 26 for activating the blower 26 for a selectable duration of time. A control knob 82 is coupled to the front face 24 of the housing 12. The control knob 82 is operationally coupled to the timer 80 for setting the selectable duration of time in the range of thirty seconds to two minutes. A motor 84 is positioned in the interior 14 of the housing 12. The motor 84 is operationally coupled to the blower 26 and the timer 80. A power cord 86 is operationally coupled to the motor 84 and the heating elements 78 through the control knob 82 for providing power to the motor 84 and heating elements 78 as needed. The power cord 86 extends from the housing 12 and has a free end 88 configured for coupling to a power outlet 90.

In use, the skate boot 34 is placed on the top 16 of the housing 12 so that the skate blade 32 is inserted into the slot 30 of the conduit 28. The skate boot 34 rests in this position while the control knob 82 is manipulated to select the duration of time the blower 26 is activated. The blower 26 and heating elements 78 are activated to provide heated air flow through the conduit 28 resulting in enhanced evaporation and drying of the skate blade 32. The skate boot 34 is removed and the next skate blade 32 to be dried may be inserted into the slot 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A skate blade drying system comprising:

a skate including a boot and a blade being attached to and extending downwardly from said boot;

a housing having an interior, a top, and a front face;

a blower positioned in said interior of said housing;

a conduit extending from said housing, said conduit having a slot extending downwardly therein, said blade being removably positioned in said slot such that said boot rests upon an upper edge of said conduit and said skate is maintained in a vertical orientation, said blower having an output port in fluid communication with said conduit for directing air flow through said conduit; and said conduit being formed by a shroud coupled to said front face of said housing, said shroud having a bottom, a front wall extending upwardly from said bottom, and a pair of end walls extending from ends of said bottom of said shroud and between said front face of said housing and side edges of said front wall of said shroud, said end walls extending upwardly and outwardly from said bottom whereby a top of said conduit is wider than said bottom of said shroud.

2. The system of claim 1, further comprising:

a plurality of feet coupled to a bottom of said housing, said feet being configured for supporting said bottom of said housing in spaced relationship to a support surface; and a plurality of vents positioned in said bottom of said housing, said vents being configured for fluid communication between said interior of said housing and a surrounding area around said housing.

3. The system of claim 1, further including a heating element positioned in said interior of said housing, said heating element being positioned proximate to said blower for heating air directed through said conduit by said blower.

4. The system of claim 1, further including a timer operationally coupled to said blower for activating said blower for a selectable duration of time.

5. The system of claim 4, further including a control knob coupled to said front of said housing, said control knob being operationally coupled to said timer for setting said selectable duration of time.

6. The system of claim 1, further including a motor positioned in said interior of said housing, said motor being operationally coupled to said blower.

7. The system of claim 6, further including a power cord operationally coupled to said motor for providing power to said motor, said power cord extending from said housing and having a free end configured for coupling to a power outlet.

8. The assembly system of claim 1, wherein said slot is formed by an upper edge of said front face of said housing, upper edges of said end walls of said shroud, and said front wall of said shroud.

9. The system of claim 8, wherein said upper edge of said front face of said housing, said upper edges of said end walls of said shroud, and said upper edge of said front wall of said shroud are all coplanar.

10. A skate blade drying system comprising:

a skate including a boot and a blade being attached to and extending downwardly from said boot;

a housing having an interior, a top, and a front face;

a blower positioned in said interior of said housing;

a conduit extending from said housing, said conduit having a slot extending downwardly therein, said blade being removably positioned in said slot such that said boot rests upon an upper edge of said conduit and said skate is maintained in a vertical orientation, said blower having an output port in fluid communication with said conduit for directing air flow through said conduit, wherein said conduit is formed by a shroud coupled to said front face of said housing, said shroud having a bottom, a front wall extending upwardly from said bottom, and a pair of end walls extending from ends of said bottom of said shroud and between said front face of said housing and side edges of said front wall of said shroud, wherein said slot is formed by an upper edge of said front face of said housing, upper edges of said end walls of said shroud, and said front wall of said shroud, wherein said upper edge of said front face of said housing, said upper edges of said end walls of said shroud, and said upper edge of said front wall of said shroud are all coplanar, and wherein said end walls extend upwardly and outwardly from said bottom whereby a top of said conduit is wider than said bottom of said shroud;

a plurality of feet coupled to a bottom of said housing, said feet being configured for supporting said bottom of said housing in spaced relationship to a support surface;

a plurality of vents positioned in said bottom of said housing, said vents being configured for fluid communication between said interior of said housing and a surrounding area around said housing;

a heating element positioned in said interior of said housing, said heating element being positioned proximate to said blower for heating air directed through said conduit by said blower;

a timer operationally coupled to said blower for activating said blower for a selectable duration of time;

a control knob coupled to said front of said housing, said control knob being operationally coupled to said timer for setting said selectable duration of time;

a motor positioned in said interior of said housing, said motor being operationally coupled to said blower; and a power cord operationally coupled to said motor for providing power to said motor, said power cord extending from said housing and having a free end configured for coupling to a power outlet.

11. A skate blade drying system comprising:

a skate including a boot and a blade being attached to and extending downwardly from said boot;

a housing having an interior, a top, and a front face;

a blower positioned in said interior of said housing;

a conduit extending from said housing, said conduit having a slot extending downwardly therein, said blade being removably positioned in said slot such that said boot rests upon an upper edge of said conduit and said skate is maintained in a vertical orientation, said blower having an output port in fluid communication with said conduit for directing air flow through said conduit, said conduit being formed by a shroud coupled to said front face of said housing, said shroud having a bottom, a front wall extending upwardly from said bottom, and a pair of end walls extending from ends of said bottom of said shroud and between said front face of said housing and side edges of said front wall of said shroud, said slot being formed by an upper edge of said front face of said housing, upper edges of said end walls of said shroud, and said front wall of said shroud.

12. The system of claim 11, further comprising:

a plurality of feet coupled to a bottom of said housing, said feet being configured for supporting said bottom of said housing in spaced relationship to a support surface; and a plurality of vents positioned in said bottom of said housing, said vents being configured for fluid communication between said interior of said housing and a surrounding area around said housing.

13. The system of claim 11, further including a heating element positioned in said interior of said housing, said heating element being positioned proximate to said blower for heating air directed through said conduit by said blower.

14. The system of claim 11, further including a timer operationally coupled to said blower for activating said blower for a selectable duration of time.

15. The system of claim 14, further including a control knob coupled to said front of said housing, said control knob being operationally coupled to said timer for setting said selectable duration of time.

16. The system of claim 11, further including a motor positioned in said interior of said housing, said motor being operationally coupled to said blower.

17. The system of claim 16, further including a power cord operationally coupled to said motor for providing power to said motor, said power cord extending from said housing and having a free end configured for coupling to a power outlet.

18. The system of claim 11, wherein said upper edge of said front face of said housing, said upper edges of said end walls of said shroud, and said upper edge of said front wall of said shroud are all coplanar.

* * * * *